United States Patent [19]

Geiss et al.

[11] 4,140,136

[45] Feb. 20, 1979

[54] PROCESS FOR REDUCTION OF NICOTINE CONTENT OF TOBACCO BY MICROBIAL TREATMENT

[75] Inventors: Vernon L. Geiss, Floyd Knobs, Ind.; Charles F. Gregory, Louisville, Ky.; Richard P. Newton, Louisville, Ky.; Lawrence E. Gravely, Louisville, Ky.

[73] Assignee: Brown & Williamson Tobacco Corporation, Louisville, Ky.

[21] Appl. No.: 787,241

[22] Filed: Apr. 13, 1977

Related U.S. Application Data

[62] Division of Ser. No. 632,804, Nov. 17, 1975, Pat. No. 4,038,993.

[51] Int. Cl.[2] ..... A24B 15/02

[52] U.S. Cl. ..... 131/17 R

[58] Field of Search ..... 131/17 R, 140 R, 141, 131/143, 140 B; 195/51 R, 2, 4

[56] References Cited

U.S. PATENT DOCUMENTS

| | | | |
|---|---|---|---|
| 2,644,462 | 7/1953 | Frankenburg | 131/141 |
| 3,132,651 | 3/1964 | Kiefer | 131/141 |
| 3,240,214 | 3/1966 | Bauley et al. | 131/141 |
| 3,256,888 | 6/1966 | de la Burde | 131/141 |
| 3,256,889 | 6/1966 | de la Burde | 131/141 |
| 3,651,816 | 3/1972 | Neurath et al. | 131/17 |

FOREIGN PATENT DOCUMENTS

| | | | |
|---|---|---|---|
| 665972 | 6/1936 | Fed. Rep. of Germany | 131/141 |
| 1692942 | 5/1971 | Fed. Rep. of Germany | 131/141 |

OTHER PUBLICATIONS

Gherna, R. L., "The Bacterial Oxidation of Nicotine", Dissertation, Univ. Southern Cal. (1964).

Deppe, K., "Research into the Oxidative Decomposition of Nicotine" by *Psuedomonas Convexa,* Dissertation, Univ. of Hamburg (1964).

Hylin, J. W., Arch. Biochem. Biophys. vol. 83, pp. 528-537 (1959).

Wada, E. et al., Science, vol. 117, pp. 152-153 (1953).

Wada, E. et al., J. Am. Chem. Soc. vol. 76, pp. 155-157 (1953).

Tabuchi, J. Agr. So. Japan vol. 29, pp. 219-225 (1954).

Tabuchi, J. Agr. Soc. Japan vol. 28, pp. 806-810 (1954).

Coussirat, J. Annales S.E.I.T.A.-D.E.E. Sect. 2, No. 10, pp. 155-172 (1973).

Bailey, E. M. et al., Conn. Agri. Expt. Station Bulletin vol. 295, pp. 338-351 (1928).

Holmes et al., J. Biol. Chem., vol. 247, No. 23, pp. 7622-7627 (1972).

Hinz, Tobacco Science, vol. 9, pp. 98-101 (1965).

Hinz et al., Tobacco Science, vol. pp. 11-13 (1967).

*Primary Examiner*—Dalton L. Truluck

*Assistant Examiner*—V. Millin

*Attorney, Agent, or Firm*—William J. Mason; Charles G. Lamb

[57] ABSTRACT

A tobacco product having a reduced nicotine content. Tobacco is subjected, under controlled conditions, to the action of a microorganism effective to degrade nicotine through a biochemical reaction in which, inter alia, 3-succinoylpyridine is formed. Tobacco treated in accordance with this process, when incorporated into a tobacco smoking product, produces a mild smoke, having a reduced nicotine content. However, there is no loss of desirable flavor, taste and smoking properties.

7 Claims, 1 Drawing Figure

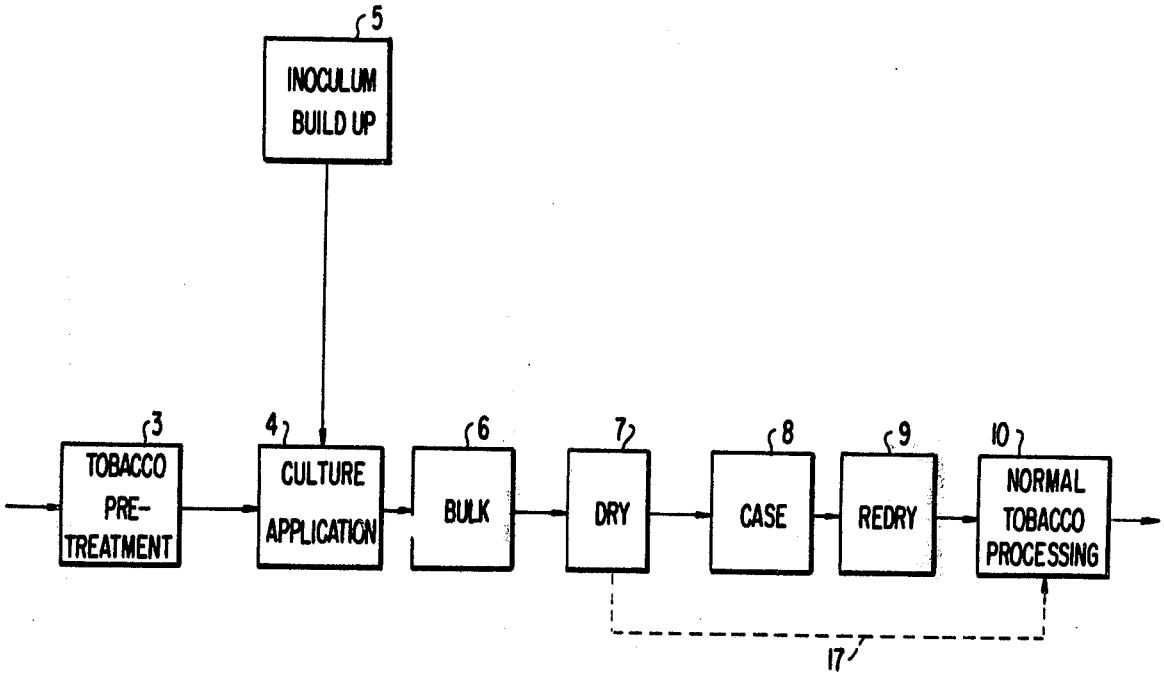
5
INOCULUM BUILD UP
3
TOBACCO PRE-TREATMENT
4
CULTURE APPLICATION
6
BULK
7
DRY
8
CASE
9
REDRY
10
NORMAL TOBACCO PROCESSING
17

PROCESS FOR REDUCTION OF NICOTINE CONTENT OF TOBACCO BY MICROBIAL TREATMENT

This is a division of application Serial No. 632,804 filed November 17, 1975 now U.S. Pat. No. 4,038,993.

FIELD OF INVENTION

The present invention pertains to a process of reducing the nicotine content of tobacco by treating the tobacco with cultures of microorganisms. More specifically, the present invention pertains to a process for treating tobacco by subjecting it to the action of particular microorganisms, under controlled conditions, whereby the nicotine content of the tobacco is reduced in a relatively short time. The process is effective to reduce the nicotine content of tobacco without substantially reducing the perceived strength of smoke generated by smoking articles produced from the tobacco. However, there is a reduction in irritating properties of smoke which is generated from tobacco treated by the process of the present invention.

BACKGROUND OF THE INVENTION

For various reasons, it is often desirable to reduce the nicotine content of tobacco. For example, in recent years, low nicotine content "mild" cigarettes have gained substantial consumer acceptance.

There are numerous techniques available for reducing the nicotine content of tobacco. However, most of these techniques result in the removal of other tobacco ingredients along with the nicotine. The removal of other ingredients adversely affects desirable flavor and taste properties, or other desirable smoking qualities. Thus, there is a need for techniques which are effective to selectively reduce the nicotine content of tobacco without deleteriously modifying its desirable smoking properties.

The microbial treatment of the present invention involves the use of microorganism cultures which are specific to nicotine whereby the nicotine content of tobacco may be substantially reduced without producing any substantial effect on other components of the tobacco. While the nicotine content of tobacco is reduced, the organoleptic properties attributed to smoke generated from the tobacco are generally maintained. However, after treatment, a milder smoke is produced.

The art of tobacco fermentation has been practiced for many years in the production of cigars, chewing tobacco, and snuff. However, treatment of cigarette tobaccos by these processes is not practical because of the long times, usually days or weeks, required for completion of fermentation. These fermentation techniques also typically result in significant losses of tobacco mass, often as much as 20% to 25% of the starting dry weight.

Treatment of nicotine, including nicotine obtained from plant sources, with microorganisms effective to degrade the nicotine through a biochemical mechanism in which 6-hydroxy nicotine is formed, is known in the art. Such a technique is disclosed in U.S. Pat. No. 3,664,176. While such microorganisms are effective to degrade relatively concentrated nicotine, their use in processing tobacco during production of smoking articles, particularly cigarettes, has not been economically feasible. An extremely long contact time between the tobacco and these microorganisms is required to achieve any significant nicotine reduction under any practical operating conditions.

In accordance with the present invention, the nicotine content of tobacco can be significantly, economically and selectively reduced without adversely affecting the tobacco. The process does not increase tobacco processing time by impractical amounts, and does not involve any significant additional energy input, since the microorganisms derive their energy almost solely from nicotine contained within the tobacco. In addition, the technique of the present invention does not result in any significant loss of tobacco mass.

The present invention provides a process for the denicotinization of tobacco by inoculating the tobacco with a particular group of microorganisms, under proper conditions of temperature, moisture and pH. The microorganisms suitable for use in the present invention are those which degrade nicotine through a biochemical reaction in which 3-succinoylpyridine, as well as 6-hydroxy-3-succinoylpyridine and other byproducts, are formed. The denicotinization process may be readily incorporated into conventional techniques for processing tobacco during manufacture of smoking products.

SUMMARY OF THE INVENTION

The present invention provides a process for reducing the nicotine content of tobacco by inoculating tobacco with a microorganism effective to degrade nicotine through a biochemical mechanism in which 3-succinoylpyridine is formed. After adding the microorganism to the tobacco, the moisture level must be maintained at a level of at least 50% by weight, based on the total weight of the tobacco and water mixture.

Subsequent to the addition of the microorganism to the tobacco, the temperature must be controlled so that it is maintained between about 20° C. and about 45° C. while the initial pH of the mixture is maintained between about 5 and about 8. The microorganism is kept in contact with the tobacco for a sufficient period of time for the microorganism to act on the nicotine contained in the tobacco. The nicotine content of the tobacco is thereby reduced by degradation to, inter alia, 3-succinoylpyridine.

Tobacco treated with the process of the present invention produces a mild, pleasant tasting smoke. The pleasant taste of smoking products containing tobacco treated by the process of the present invention may be due, in part, to the presence of flavor altering amounts of nicotine degradation products, particularly 3-succinoylpyridine and 6-hydroxy-3-succinoylpyridine.

The technique of the present invention can be used to produce nicotine degradation products by applying the microorganisms to an aqueous medium containing a source of nicotine, which may or may not be tobacco. When used for such a purpose, the process should be regulated to maintain an initial nicotine concentration of from about 0.1 mg. nicotine per ml. of water to about 14 mg. nicotine per ml. of water. The degradation products, such as 3-succinoylpyridine and 6-hydroxy-3-succinoylpyridine may be recovered and used as flavoring additions to smoking products.

The process of the present invention is particularly useful for treating burley tobacco. Burley normally has a relatively high nicotine content and produces a rather harsh smoke. Conventionally, burley tobacco is treated with casing compositions to reduce harshness. Treatment by the process of the present invention not only reduces the nicotine content, but reduces harshness to the extent that burley may be employed in smoking products without casing.

BRIEF DESCRIPTION OF THE DRAWINGS

The FIGURE is a schematic block diagram illustrating a tobacco leaf treating process which includes the microbial treatment of the present invention.

DESCRIPTION OF THE PREFERRED EMBODIMENTS

Pure culture isolates of bacteria effective in degrading nicotine through a biochemical mechanism in which 3-succinoylpyridine is formed, which are suitable for use in the present invention, can be obtained by culture enrichment techniques. Three bacteria species, of the type suitable for use in the present process, have been obtained from cigar tobacco.

Puerto Rican cigar tobacco (500 grams) was adjusted to an 80% moisture level with water, bulked tightly, enclosed in plastic, and allowed to incubate over night at approximately 25° C. Sampling for alkaloids in the tobacco and rebulking took place after 18 hours. The incubation and rebulking cycle continued for a few days until the alkaloid level in the tobacco was very low.

After a few days, five grams of the treated cigar tobacco was added to a flask of nicotine broth and incubated at 30° C. with shaking. The nicotine broth comprised 0.02 g. $FeSO_4$, 4ml. nicotine, 2.0 g. $KH_2PO_4$, 5.0 g. KCl, 0.2 g. $MgSO_4$, 0.1 g. yeast extract, and one liter of water to make a broth having a pH of 6.8.

Subsequent alkaloid analysis of the nicotine broth showed that the nicotine was decomposed. Nicotine was added to the broth to return the nicotine level to 4 mg./ml. This in turn was depleted. Fresh nicotine broth was inoculated from the first flask and again, nicotine depletion occurred. Fresh media with additional nicotine were used through several successive transfers.

Materials from the flasks of inoculated nicotine broth were streaked on nicote agar, having the same composition as the nicotine broth, except for the addition of 1.5% agar, and incubated at 30° C. The most vigorous colonies of bacteria which developed on the nicotine agar were restreaked several times to obtain pure strains.

From the original colonies, three strains of bacteria were obtained, identified and deposited with the U.S. Department of Agriculture (at the Northern Regional Research Laboratory, Peoria, Ill.). One strain, referred to herein as isolate *Cellulomonas sp.* (NRRL B-8063), had irregular colonies. Another referred to herein as isolate *Pseudomonas putida* (NRRL B-8062), had smooth milky colonies, and the third, referred to herein as isolate *Pseudomonas putida* (NRRL B-8061), had smooth white colonies.

Strains NRRL B-8061 and NRRL B-8062 show a more aggressive nicotine degrading tendency than strain NRRL B-8063. *Pseudomonas putida* (NRRL B-8061) is the preferred microorganism for use in the process of the present invention, although *Pseudomonas putida* (NRRL B-8062) is very similar in most capabilities. The morphological and biochemical characteristics of *Pseudomonas putida* (NRRL B-8061 and NRRL B-8062) and *Cellulomas sp.* (NRRL B-8063) are shown in Tables I, II and III, respectively.

While strains NRRL B-8061, B-8062 and B-8063 have been described in detail, the process of the present invention is not limited to the use of these specific organisms. Any microorganisms which are effective to degrade nicotine through a biochemical mechanism in which 3-succinoylpyridine is formed may be employed. Of course, the microorganisms may be effective to produce nicotine degradation products other than 3-succinoylpyridine and it should not be implied that this is the sole degradation product which is produced.

To be suitable for use in the process of the present invention, it is only essential that the microorganisms be effective to degrade nicotine to 3-succinoylpyridine; it is irrelevant if other degradation products also are produced. Microorganisms which degrade nicotine without producing any significant quantities of 3-succinoylpyridine, such as those which degrade nicotine to 6-hydroxynicotine, are not suitable for use in the present invention.

The technique of the present invention, used in connection with a technique for processing tobacco for the manufacture of smoking articles such as cigarettes is illustrated in the FIGURE.

TABLE I

MORPHOLOGICAL AND BIOCHEMICAL CHARACTERISTICS OF *PSEUDOMONAS PUTIDA* (NRRL B-8061)

A. MORPHOLOGY

Rods, oval to short in shape, 0.8–1.0 microns (diameter) by 1.0–2.2 microns (length); predominantly coccoidal. Form pairs and longer filaments.

Colony Form:

Nutrient Agar: Opalescent, light tan or cream colored, flat smooth edges.

Peptone Yeast Extract Agar: Appearance much like that on Nutrient Agar; accompanied by the formation of a diffusible yellow pigment which fluoresces under ultraviolet light. This pigment produced well in media with glucose present.

Nicotine Agar: Filiform, opaque, pearl-gray, butyrous, glistening.

Brain Heart Infusion Agar: Circular, umbonate, rugose, undulate, glistening, opaque, pearl-gray.

Growth type in static Brain Heart Infusion Broth: Turbid, membranous surface growth, flocculent sediment, heavy growth.

Gram negative

Motile by three or more polar flagella.

B. PHYSIOLOGY

Obligate aerobe. Strongly aerotactic.

Optimum growth: 25°–30° C. Range: 12°–37° C.

Nitrate reduced to nitrite, no gas formed.

Tellurite Reduction: negative.

Growth with Benzoic acid as substrate. Growth with citrate as sole carbon source, forming fluorescent yellow pigment.

No growth on trehalose, or with mandelic acid, 2-hydroxypyridine or pyridine.

Hydrolysis of arginine, positive. Gelatin, starch, cellulose, casein, and urea not hydrolyzed.

Lactic acid produced.

Oxidase produced.

Ammonia produced.

Acid and hydrogen sulfide not produced.

Catalase present.

Acetylmethyl-carbinol and indole not present.

Litmus milk: Alkaline, then reduced.

No hemolysis of blood agar.

Acid but no gas from: Adonitol, arabinose, cellobiose, dulcitol, fructose, galactose, mannose, melibiose, raffinoise, rhamnose, salicin.

Growth with no acid or gas production with lactose, sucrose, maltose, glucose, xylose, dextrin, glycerol, mannitol, and inositol.

Growth but no phenazine pigment production on Kings medium A. Growth and fluorescent pigment on Kings medium B.

Grows with nicotine and nicotinic acid as sole sources of carbon. Ultraviolet spectrum of the growth liquid at time of pigmentation shows accumulation of 2,5-dihydroxypyridine with both substrates.

GC ratio: Melting point method: 62.5. CsCl density gradient centrifugation: 63.2.

Pathogenicity: Non-pathogenic to guinea pigs when fed orally or injected intraperitoneally.

Source: Tobacco.

TABLE II

MORPHOLOGICAL AND BIOCHEMICAL CHARACTERISTICS OF *PSEUDOMONAS PUTIDA* (NRRL B-8062)

A. MORPHOLOGY

Rods, oval to short in shape, 0.8–1.0 microns (diameter) by 1.0–2.2 microns (length); predominantly coccoidal. Form pairs and longer filaments.

Colony Form:

Nutrient Agar: Opalescent, light tan or cream colored, flat smooth edges.

Peptone Yeast Extract Agar: Appearance much like that on Nutrient Agar; accompanied by the formation of a diffusible yellow pigment which fluoresces under ultraviolet light. This pigment produced well in media with glucose present.

Nicotine Agar: Filiform, opaque, pearl-gray, butyrous, glistening.

Brain Heart Infusion Agar: Circular, umbonate, rugose, undulate, glistening, opaque, pearl-gray.

Growth type in static Brain Heart Infusion Broth: Turbid, membraneous surface growth, flocculent sediment, heavy growth.

Gram negative.

Motile by three or more polar flagella.

B. PHYSIOLOGY

Obligate aerobe. Strongly aerotactic.

Optimum growth: 25°–30° C. Range: 12°–37° C.

Nitrate reduced to nitrite, no gas formed.

Tellurite Reduction: negative.

Growth with Benzoic acid as substrate. Growth with citrate as sole carbon source, forming fluorescent yellow pigment.

No growth on trehalose, or with mandelic acid, 2-hydroxypyridine or pyridine.

Hydrolysis of arginine, positive. Gelatin, starch, cellulose, casein, and urea not hydrolyzed.

Lactic acid produced.

Oxidase produced.

Ammonia not produced.

Acid and hydrogen sulfide not produced.

Catalase present.

Acetylmethyl-carbinol and indole not present.

Litmus milk: Alkaline, then reduced.

No hemolysis of blood agar.

Acid but no gas from: Adonitol, arabinose, cellobiose, dulcitol, fructose, galactose, mannose, melibiose, raffinose, rhamnose, salicin.

Growth with no acid or gas production with lactose, sucrose, maltose, glucose, xylose, dextrin, glycerol, mannitol, and inositol.

Growth but no phenazine pigment production on Kings medium A. Growth and fluorescent pigment on Kings medium B.

Grows with nicotine and nicotinic acid as sole sources of carbon. Ultraviolet spectrum of the growth liquid at time of pigmentation shows accumulation of 2,5-dihydroxypyridine with both substrates.

GC ratio: Melting point method: 61.0. CsCl density gradient centrifugation: 62.0.

Pathogenicity: Non-pathogenic to guinea pigs when fed orally or injected intraperitoneally.

Source: Tobacco.

TABLE III

MORPHOLOGICAL AND BIOCHEMICAL CHARACTERISTICS OF *CELLULOMONAS SP.* (NRRL B-8063)

A. MORPHOLOGY

Cells are thin, bent or almost vibroid rods with a diameter of 0.5–0.7 microns and length of 1.5–2.5 microns.

Colony Form:

Nutrient Agar: Small, yellow, flat, butyrous, and with smooth edges.

Peptone Yeast Extract Agar: Similar appearance to that on nutrient Agar. No exocellular pigments were formed when growing on a variety of media, including nicotine.

Nicotine Agar: Filiform, opaque, pearl-gray, membranous, dull.

Brain Heart Infusion Agar: Circular, umbonate, contoured, undulate, dull, opaque, pearl-gray.

Growth type in static Brain Heart Infusion Broth: Turbid, viscid, ringed, moderate growth.

Gram positive when young, variable as stationary growth is reached.

Motile by tumbling action. Cells possess 1 or 2 polar flagella.

B. PHYSIOLOGY

Facultative anaerobe; obligate aerobe when nitrate is present.

Optimum growth: 28°–30° C. Range: 15°–37° C.

Reduces nitrate to nitrite and actively produces nitrogen gas.

Grows with nicotine and benzoic acid as sole carbon sources. No pigment formed. Spectral scans of growth liquor from nicotine showed no evidence of dipyridols.

No growth with mandelic acid, 2-hydroxypyridine, or pyridine.

No hydrolysis of gelatin, starch, cellulose, casein, urea, or arginine.

Grows with citrate as sole carbon source.

Tellurite reduction: negative.

No production of hydrogen sulfide.

Lactic acid, oxidase and ammonia produced.

Catalase, positive.

Indole present, weak.

Acetylmethyl-carbinol not present.

Litmus milk, alkaline, then reduced.

No pigment on Kings A or B medium.

Growth with no acid or gas production on glucose, sucrose, maltose, fructose, galactose, raffinose, xylose, salicin, adonitol, glycerol, and inositol.

No growth on lactose.

Acid but no gas from: arabinose, cellobiose, mannose, melibiose, rhamnose, dextrin, dulcitol, and mannitol.

No hemolysis of blood agar.

GC ratio: Melting point method, 69.2. CsCl density gradient centrifugation, 68.9.

Pathogenicity: Non-pathogenic to guinea pigs when fed orally or injected intraperitoneally.

Source: Tobacco.

In accordance with this technique, tobacco is subjected to a pretreatment 3. The pretreatment may involve nothing more than the conventional step of subjecting the tobacco to conditions of controlled temperature and controlled moisture to improve its handleability.

After pretreatment, the microbial culture is applied to the tobacco 4. Prior to inoculating with the microbial culture, an inoculum build-up 5 is obtained.

A culture of the microorganism is grown in a nicotine containing broth, preferably a burley tobacco extract broth. The broth should be subjected to aeration and agitation during build-up. Normally, mild aeration and agitation, such as is obtained by relatively low speed stirring of the broth, is adequate. The broth should have an initial pH of between about 5 and 8, and preferably between about 6.2 and 7.8. In addition, the broth should be maintained between about 10° C. and 45° C., and preferably between about 28° C. and 32° C.

The broth should have an initial nicotine concentration of at least 0.1 mg. per ml., and preferably at least 1.5 mg. per ml. Of course, the broth should not contain nicotine concentrations of more than amounts which will be toxic to the microorganisms. Concentrations of nicotine greater than about 12 mg. per ml. normally substantially slow microorganism growth.

Subsequent to inoculation of the tobacco with the microorganism, the moisture content of the inoculated tobacco is maintained at a level of at least 50% by weight, based on the total weight of the tobacco and water mixture. Preferably, the moisture content is maintained at a level of at least 65% by weight. In some instances, the inoculum may be advantageously added to an aqueous slurry of tobacco, such as are often employed in making reconstituted tobacco sheets and the like. Typically, such slurries contain up to 20% by weight tobacco. By treating slurries used in making reconstituted tobacco, denicotinization may be achieved without the need for a separate step of removing the water from the tobacco which is needed for the process of the present invention.

The temperature of the inoculated tobacco is maintained between about 20° C. and about 45° C., preferably between about 27° C. and about 32° C. The initial pH of the inoculated tobacco is maintained between about 5 and about 8, preferably between about 6 and about 7.5.

Subsequent to inoculation, the tobacco is bulked 6. Bulking involves nothing more than a static treatment, under aerobic conditions, at the moisture, temperature, and pH conditions referred to above. Bulking allows time for the microorganism to act on the tobacco, thereby reducing the alkaloid (nicotine) content. At times, intermittent mixing can be beneficial.

To maintain the initial pH within the desired limits, it may be necessary to add a small amount of an alkaline material, such as an ammonium hydroxide or sodium hydroxide solution, to the tobacco. However, many tobaccos will inherently have a pH within the desired range and will require no adjustment.

The amount of bacteria which is added to the tobacco is not critical. Even very small amounts of bacteria will grow, producing a significant nicotine reduction, provided that the microorganism is maintained in contact with the tobacco for a sufficient period of time. Very large amounts of bacteria are not deleterious, and therefore, the maximum amount of bacteria which may be applied is dictated only by economic considerations. Obviously, the more bacteria applied, the more rapid the denicotinization process. As a practical matter, amounts of bacteria of at least $1.0 \times 10^7$ cells per gram dry weight of the tobacco may be suitably employed.

The time period during which the bacteria are maintained in contact with the tobacco also is not critical. In some instances, where a large degree of denicotinization is desired, contact times up to about 50 hours or more may be employed.

Normally, commercial considerations dictate that the denicotinization take place fairly rapidly. In addition, long contact times result in some loss of tobacco mass.

It has been found that significant nicotine reduction can be achieved in from about 1 to 10 hours. To achieve significant nicotine reduction in time periods of less than one hour would require the use of a very concentrated bacterial inoculum. In commercial processing of tobacco, it is desirable to complete denicotinization in less than 10 hours. The time required to accomplish a given level of nicotine reduction is accelerated as the particle size of the tobacco is reduced.

After bulking, the tobacco is dried 7 to achieve moisture levels conventionally employed in processing tobacco. Subsequent to drying, casings may be applied 8 and the tobacco can be redried 9 before continuing normal processing 10.

The process of the present invention is compatible with the use of conventional tobacco casing compositions and techniques. As is well known in the art, casing solutions, containing such materials as sugars, syrups, licorice, honey, chocolate, balsams, etc. are added to burley or blended leaf tobaccos, as flavorants and to mellow and lessen the harshness of such tobaccos.

In some situations, casing of the treated tobacco may not be required or desirable. In such instances, the casing 8 and redrying step 9 may be eliminated by following alternate route 17 directly to normal process flow. For example, normally harsh burley tobacco is mellowed by the microbial treatment and thus when no treated can be incorporated into smoking products without being cased.

A preferred process for treating tobacco in accordance with the technique of the present invention is disclosed in application Ser. No. 632,863 (filed on the same date as the present application by Newton, Geiss, Jewell and Gravely), now U.S. Pat. No. 4,037,609 which is incorporated herein by reference. A technique for maximizing culture activity is disclosed in application Ser. No. 632,857 (filed on the same date as the present application by Gravely, Geiss and Newton), now U.S. Pat. No. 4,011,141 which is also incorporated herein by reference.

The process of the present invention is effective to reduce the nicotine content of tobacco and tobacco parts. Various forms of tobacco, in varying degrees and stages of curing, may be employed. For example, the process may be employed with unredried flue-cured or burley strips, redried flue-cured or burley strips, burley stems, flue-cured stems, manufacturing fines, stocks, shredded tobacco, and mixtures thereof. The process may also be employed with nicotine containing materials used to produce products such as tobacco substitutes and reconstituted tobacco.

Tobacco treated by the process of the present invention is highly suitable for use in the manufacture of tobacco smoke products, such as cigarettes. The tobacco is uniquely well suited for use in tobacco products in which a low nicotine content is desired. Smoke from tobacco treated in accordance with the process of the present invention, when incorporated into a tobacco smoking product, gives reduced nicotine deliveries, as well as desirable flavor and taste properties. The presence of minor amounts, such as amounts inherently present in tobacco treated by the process of the present invention, of nicotine degradation products, particularly 3-succinoylpyridine and 6-hydroxy-3-succinoylpyridine, are effective to impart desirable smoking flavor and taste properties.

While the process of the present invention has been primarily described with respect to denicotinization of tobacco, it also can be employed to produce nicotine degradation products, particularly 3-succinoylpyridine and 6-hydroxy-3-succinoylpyridine. When used for such a purpose, the source of nicotine, of course, does not need to be tobacco. In such a process, the initial nicotine concentration is maintained at from about 0.1 mg. nicotine per ml. of water to about 14 mg. nicotine per ml. of water, and preferably from about 1 mg. to about 2 mg. nicotine per ml. of water. The microorganism is preferably added in amounts of at least $1 \times 10^7$ cells per ml. of water. Other treatment conditions are the same as those employed in the denicotinization process.

3-succinoylpyridine can be recovered from the aqueous treatment mixture by filtering the medium, removing the water by evaporation, and extracting the residue with hot chloroform. Upon evaporation of the chloroform, 3-succinoylpyridine remains.

6-hydroxy-3-succinoylpyridine may be recovered by filtering the culture, concentrating the solution tenfold by evaporating water, and acidifying the concentrated solution with HCl to a pH of about 3. The precipitate which forms may be collected by centrifugation, washed with dilute HCl and ether, and dried.

The process of the present invention may be further illustrated by the following specific examples. The examples are intended merely to illustrate specific embodiments, and are in no way limiting.

EXAMPLE 1

PREPARATION OF INOCULUM

Nicotine Agar and Broth

Nicotine agar was prepared according to the following formula:

| | |
|---|---|
| Nicotine | 4.0 ml. |
| $FeSO_4$ | 0.025 gm. |
| $KH_2PO_4$ | 2.0 gm. |
| KCl | 5.0 gm. |
| $MgSO_4$ | 0.25 gm. |
| Yeast Extract | 0.1 gm. |
| Agar | 15.0 gm |
| Distilled or Deionized water | To make 1 liter |
| Final pH 6.8 | |

The medium is sterilized in an autoclave for 15 minutes at 15 psig and 121° C. Nicotine is usually added to the medium just prior to use. A broth of the above medium is prepared by omitting the addition of agar.

Tobacco-Nicotine Broth

An extract of burley tobacco is prepared as follows: 100 grams of burley tobacco is mixed with 1000 mls of water and cooked in an autoclave for 25 minutes at 15 psig and 121° C. The resultant effluent liquor is removed and the volume adjusted to the original amount. An equal volume of an aqueous broth containing 0.05 gm. $FeSO_4$, 4.0 gm. $KH_2PO_4$, 10.0 gm. KCl, 0.5 gm. $MgSO_4$ and 0.2 gm. yeast extract is added to the burley tobacco extract. The medium is sterilized in an autoclave for 15 minutes at 15 psig and 121° C. Just prior to use, nicotine is added to give a final nicotine concentration of 4.0 mg./ml. Flue-cured tobacco can be used successfully in this medium in place of burley tobacco.

Tobacco Extract Broth

Tobacco extract broth is prepared in the same manner as the burley extract used in the tobacco-nicotine broth. Water may or may not be added, depending upon the final nicotine concentration desired.

Broth Inoculation

The microorganisms, such as strain NRRL B-8061, are incubated on agar slants for 24 to 72 hours at 30° C. Liquid media, for example tobacco-nicotine broth, are inoculated with a sterile water wash from slants which have been diluted to an optical density of 0.5 as read at 650 mu on a spectrophotometer (B&L SPECTRONIC 20). A 1% (v/v) inoculum rate of the standardized suspension is added to one of the broth media for culture propagation. Optimum growth is achieved by employing rotary agitation for 24 to 48 hours at 30° C. and 220 rpm.

EXAMPLE 2

Typical data for the degradation of nicotine by *P. putida* (NRRL B-8061) in liquid media are shown below. These trials were performed at 30° C. and rotary agitation at 220 RPM in Erlenmeyer flasks.

| | Total Alkaloids (mg/ml) | Broth pH | % Reduction |
|---|---|---|---|
| Nicotine Broth | | | |
| 0 hours | 3.85 | 6.5 | 94.3 |
| 20 hours | 0.22 | 5.5 | |
| Tobacco-Nicotine Broth | | | |
| 0 hours | 4.80 | 6.5 | 85.4 |
| 16 hours | 0.70 | 7.5 | |
| Nicotine-Water Mixture | | | |
| 0 hours | 1.72 | 6.5 | 95.9 |
| 72 hours | 0.07 | 5.3 | |
| Tobacco Extract | | | |
| 0 hours | 1.61 | 5.5 | 93.8 |
| 17 hours | 0.10 | 6.9 | |

In each case, uninoculated controls show little or no change in the alkaloid content of the mixtures.

EXAMPLE 3

The ability of pure culture strains NRRL B-8061, NRRL B-8062 and NRRL B-8063 to degrade nicotine was compared in tobacco-nicotine broth, using both burley and flue-cured tobacco extracts as described in Example 1. Nicotine agar slant washings of each culture were prepared as inoculum and the broth cultures were incubated as described in Example 1. Results of these trials are shown below:

| Strain | Broth | Alkaloid Content (mg/ml) 0 Hours | 24 Hours | 96 Hours | % Reduction |
|---|---|---|---|---|---|
| NRRL B-8061 | Burley-nicotine | 4.90 | 0.30 | 0.10 | 98.0 |
| | Flue-cured nicotine | 4.90 | 0.63 | 0.12 | 97.6 |
| NRRL B-8062 | Burley-nicotine | 5.15 | 2.15 | 0.07 | 98.6 |
| | Flue-cured nicotine | 4.95 | 3.10 | 0.07 | 98.6 |
| NRRL B-8063 | Burley-nicotine | 5.35 | 2.53 | 0.08 | 98.5 |
| | Flue-cured nicotine | 4.95 | 3.85 | 0.09 | 98.2 |

It is obvious from the above data that all three microorganisms are effective with either burley or flue-cured tobacco.

EXAMPLE 4

Two hundred mls of a water-tobacco mixture having a consistency of 8% (w/w), more commonly referred to as tobacco slurry for making reconstituted tobacco, was inoculated with 50 mls of *Pseudomonas putida* (NRRL B-8061) grown in tobacco-nicotine broth as described in Example 1. The inoculated tobacco slurry was incubated for 24 hours at 25° C., while being subjected to rotary agitation at 220 RPM. A control sample in which sterile water replaced the inoculum was processed. At selected points during the treatment, the slurries were handcast on a stainless steel sheet mounted over a steam bath and dried. The percent total alkaloids of the resultant sheets before and after treatment were as follows:

| | % Total Alkaloids |
|---|---|
| Inoculated with *P. putida* (NRRL B-8061) | |
| 0 hours | 1.00 |
| 8 hours | 0.45 |
| 24 hours | 0.25 |
| Uninoculated Control | |
| 0 hours | 1.00 |
| 8 hours | 1.10 |
| 24 hours | 0.95 |

EXAMPLE 5

*P. putida* (NRRL B-8061) was grown in nicotine broth containing 2 mg/ml nicotine and 4 mg/ml TRYPTICASE (BBL). The culture was incubated for 20 hours as described in Example 1. The culture (50 ml) was then centrifuged for 25 minutes at 16,300 × G (Sorvall RC2-B centrifuge, GSA Head, 10,000 RPM) to separate the cells from supernatant. The supernatant and cellular pellet were separated and the supernatant filtered through a 0.22 micron millipore filter to remove residual cells. Ten grams of burley tobacco were mixed with 30 ml of millipore filtered supernatant. Likewise the cellular pellet was resuspended in 30 ml of water which in turn was mixed with ten grams of burley tobacco. Both samples were incubated for 16 hours at 25° C. Results of this trial are shown below:

| | % Total Alkaloids |
|---|---|
| Pellet (*P. putid.* NRRL B-8061) | |
| 0 hours | 2.88 |
| 5 hours | 2.65 |
| 72 hours | 0.33 |

-continued

| | % Total Alkaloids |
|---|---|
| Supernatant | |
| 0 hours | 2.80 |
| 5 hours | 2.78 |
| 72 hours | 2.88 |

EXAMPLE 6

One thousand grams of shredded burley tobacco were mixed with 1846 grams of water and 1000 grams *P. putida* (NRRL B-8061) broth inoculum prepared in burley-nicotine broth as described in Example 1. The inoculated tobacco was placed 2–3 inches deep in a tray and covered with a plastic sheet. The plastic sheet prevented excessive moisture loss but did not provide an airtight seal. The tobacco was maintained at 25° C. for 24 hours. A control sample was prepared in the same manner except that an appropriate amount of sterile water was substituted for the inoculum. The total alkaloid contents and pH of these samples were as follows:

| | % Total Alkaloid | pH of Wet Tobacco |
|---|---|---|
| Inoculated with *P. putida* (NRRL B-8061) | | |
| 0 hours | 3.45 | 6.3 |
| 24 hours | 0.60 | 8.5 |
| Uninoculated Control | | |
| 0 hours | 3.29 | 6.3 |
| 24 hours | 3.40 | 6.4 |

EXAMPLE 7

Ten pounds of flue-cured tobacco were mixed with 20 pounds of 0.15 N $NH_4OH$ and 10 pounds of *P. putida* (NRRL B-8061) inoculum prepared in burley-nicotine broth as described in Example 1. The $NH_4OH$ was added to increase the initial pH of the tobacco. The tobacco was placed in trays 4–5 inches deep and covered with a plastic sheet. The plastic prevented excessive moisture loss but did not provide an airtight seal. The tobacco was maintained at 25° C. for 18 hours. A control sample was prepared in the same manner except that an appropriate amount of sterile water was substituted for the inoculum. The total alkaloid contents and pH values for these samples were as follows:

| | % Total Alkaloids | pH of Dry Tobacco |
|---|---|---|
| Inoculated with *P. putida* (NRRL B-8061) | | |
| 0 hours | 1.74 | 7.0 |
| 18 hours | 0.20 | 6.8 |
| Uninoculated Control | | |
| 0 hours | 1.71 | 7.1 |
| 18 hours | 1.97 | 6.8 |

EXAMPLE 8

Ten pounds of a blend of burley and flue-cured tobacco of approximately equal proportions, were treated in the same manner as described in Example 7. Results of this trial were as follows:

| | % Total Alkaloids | pH of Dry Tobacco |
|---|---|---|
| Inoculated with *P. putida* (NRRL B-8061) | | |

-continued

| | % Total Alkaloids | pH of Dry Tobacco |
|---|---|---|
| 0 hours | 1.93 | 6.5 |
| 18 hours | 0.30 | 7.6 |
| Uninoculated Control | | |
| 0 hours | 1.90 | 6.5 |
| 18 hours | 1.70 | 6.8 |

EXAMPLE 9

Five grams of a blend of ground (−20 mesh, U.S. Sieve) burley and flue-cured stems, of approximately equal proportions, were mixed with 6 ml of water and 5 ml of *P. putida* (NRRL B-8061) inoculum prepared in burley-nicotine broth as described in Example 1. The inoculated tobacco was placed in a petri dish and covered with a plastic sheet. The plastic sheet prevented excessive moisture loss but did not cause an airtight seal. The tobacco was held at 30° C. for 5 hours. A control sample was prepared in the same manner except that an appropriate amount of sterile water was substituted for the inoculum. The alkaloid content of the inoculated sample was reduced from 0.55% to 0.13%. The alkaloid content of the control sample did not change.

EXAMPLE 10

A blend of burley and flue-cured tobaccos, of approximately equal proportions, was treated in the same manner as described in Example 8. After microbial treatment, this shredded tobacco was made into cigarettes. The formed cigarettes were smoked on a constant vacuum smoking machine taking one puff per minute with a two second puff duration, and a 35 ml puff volume. The results of these trials were as follows:

| | Total Alkaloid Level of Tobacco Blend (%) | Puff No. | Smoke Analyses (per cig.) Tar (mg) | Nicotine (mg) |
|---|---|---|---|---|
| Uninoculated Control | 2.00 | 9.2 | 18.2 | 1.58 |
| Inoculated-Trial A | 0.85 | 9.2 | 17.6 | 0.98 |
| Inoculated-Trial B | 0.45 | 8.8 | 17.8 | 0.71 |

Thus, it can be seen that the smoke nicotine is significantly reduced without a concommitant reduction in tar delivery. Those skilled in the art normally associate tar deliveries with the taste and aroma properties of a cigarette. To this end, the cigarettes of this example were subjectively evaluated by a panel of smokers trained to distinguish between and measure the perceived strength, taste and irritation of smoke.

The microbial treated cigarettes were rated as having smoke strength and taste comparable to control but also having milder tobacco smoke properties when compared to untreated cigarette smoke.

EXAMPLE 11

A blend of burley tobaccos was treated in the same manner as described in Example 6, with the exception that the inoculum weight was 50% of the tobacco dry weight. After microbial treatment, the burley tobaccos were mixed with an approximately equal proportion of an untreated flue-cured blend. The total alkaloid content of the burley blend was reduced from 4.06 to 1.71%. After mixing the burley and flue-cured tobaccos, the total alkaloid content was 1.6% as compared to 2.0% for the untreated control.

The treated and control samples were formed into filter tip cigarettes and smoked on a constant vacuum smoking machine as described in Example 10. Results of this trial were as follows:

| | Puff No. | Smoke Analyses (per puff) Tar (mg) | Nicotine (mg) |
|---|---|---|---|
| Uninoculated Control | 8.4 | 1.90 | 0.16 |
| Inoculated | 8.1 | 1.84 | 0.13 |

The same general relationships for smoke chemistry are evident as stated in Example 10.

From the foregoing it is obvious therefore that the nicotine content in nicotine containing solutions and/or tobacco can be effectively reduced in a controlled manner up to about 90% or more. Further, the tobacco products made from the so treated tobacco were rated by a smokers' evaluation panel as having comparable strength and organoleptic properties of taste and aroma in comparison to an untreated control.

EXAMPLE 12

*P. putida* (NRRL B-8061) cells were collected by centrifugation as described in Example 5 from nicotine broth cultures grown as described in Example 1. The cells from 500 mls of culture were resuspended in 300 mls of water to which 0.60 ml of nicotine was added. The pH was adjusted to 6.5 and the mixture placed on a shaker for mild agitation at 30° C. Analytical samples were prepared for determination of their ultraviolet absorption spectrum. With time, the nicotine absorption curve (maximum 259 mm) was replaced by the absorption pattern of 3-succinoylpyridine (large maximum 232 mm, smaller maximum 267 mm) which in turn was replaced by the absorption pattern of 6-hydroxy-3-succinoylpyridine (maximum 275 mm). Collection of 6-hydroxy-3-succinoylpyridine was by Millipore filtering the culture when the U.V. spectrum indicated its presence, concentrating the solution tenfold and acidifying the solution with HCl to pH about 3. The precipitate which formed was collected by centrifugation, washed with 0.05 N HCl, then ether, and dried.

3-succinoylpyridine was collected by filtering the medium when its concentration was greatest, removing the water by evapoation, and extracting the residue with hot chloroform. Upon evaporation of the chloroform a residue of 3-succinoylpyridine remained.

EXAMPLE 13

Equal and separate quantities of tobacco-nicotine broth of Example 1 were inoculated with strains NRRL B-8061, NRRL B-8062 and NRRL B-8063 and the nicotine containing broth of Example 1 was subjected to the action of the strains. The total alkaloid content and the products formed are as follows:

| Isolate | Broth | Starting Total Alkaloid Content (mg/ml) | Total Alkaloid After 96 Hrs. (mg/ml) |
|---|---|---|---|
| NRRL B-8061 | Burley-nicotine | 4.90 | 0.10 |
| | Flue-cured nicotine | 4.90 | 0.12 |
| NRRL B-8062 | Burley-nicotine | 5.15 | 0.07 |
| | Flue-cured nicotine | 4.95 | 0.07 |
| NRRL | Burley-nicotine | 5.35 | 0.08 |

-continued

| Isolate | Broth | Starting Total Alkaloid Content (mg/ml) | Total Alkaloid After 96 Hrs. (mg/ml) |
|---|---|---|---|
| B-8063 | Flue-cured nicotine | 4.95 | 0.09 |

Upon analysis, as described in Example 12, of the products formed by the action of strains NRRL B-8061, NRRL B-8062 and NRRL B-8063, each tobacco-nicotine broth yields 3-succinoylpyridine and 6-hydroxy-3-succinoylpyridine. Analyses of the inoculated tobacco-nicotine broth at the start of microbial action were negative as to the presence of the above two named compounds, but upon completion of the microbial action, the nicotine content was substantially reduced and the presence of 3-succinoylpyridine and 6-hydroxy-3-succinoylpyridine was found.

EXAMPLE 14

Cultures of *P. putida* (NRRL B-8061) which degrades nicotine by a pathway which includes 3-succinoylpyridine formation, and *Arthrobacter oxydans* (ATCC 14358), which uses a nicotine degradation pathway which begins with 6-hydroxynicotine formation, were grown in shake flasks as described in Example 5. The cells in each culture were collected by centrifugation, and resuspended in 50 mls of sterile water. Thirty mls of each suspension was mixed with separate 10 gm quantities of burley tobacco lamina. A portion of each tobacco treatment was air dried immediately. The remainder of the tobacco was placed in covered glass dishes with ventilation at room temperature. After 16 hours this tobacco was air dried. Alkaloid analyses were performed giving the following results:

| Tobacco Description | Alkaloid Content (% Dry Wt) |
|---|---|
| Untreated Tobacco | 3.55 |
| Strain NRRL B-8061 treated tobacco-no incubation | 3.25 |
| Strain NRRL B-8061 treated tobacco-16 hours incubation | 0.76 |
| *A. oxydans* treated tobacco-no incubation | 3.42 |
| *A. oxydans* treated tobacco-16 hours incubation | 3.55 |

EXAMPLE 15

A culture of *P. putida* (NRRL B-8061) (250 ml) was grown in nicotine broth as described in Example 1. The cells from the mature culture were collected by centrifugation as described in Example 5, and resuspended in 31 mls of water. This resulted in an 8-fold concentration of the inoculum. Ten-gram tobacco samples were inoculated with either 1, 5 or 25 mls of the concentrated inoculum with water included to make a total volume of 30 mls. After a thorough mixing the treated tobaccos were immediately air dried. When dry the alkaloid levels were as follows:

| Amount of Concentrated Inoculum | Ratio of Inoculum to Tobacco (Wt)* | Alkaloids (% Dry Wt) |
|---|---|---|
| Untreated Tobacco | — | 3.51 |
| 1 ml inoculum | 0.8:1 | 3.48 |
| 5 ml inoculum | 4:1 | 2.98 |
| 25 ml of inoculum | 20:1 | 1.94 |

*Normally the unconcentrated inoculum application rate is a 1:1 ratio of inoculum and tobacco by weight. Inoculum/tobacco ratios of 2:1 and 3:1 are possible without concentrating the inoculum, when tobacco moisture does not exceed 75%. Inoculum concentration is required when an inoculum/tobacco ratio greater than 3:1 are used when tobacco moisture does not exceed 75%.

EXAMPLE 16

*P. putida* (NRRL B-8061) cultures were prepared as described in Example 1. The cultures were used to treat burley tobacco in two distinct although similar ways. The tobacco treatments were performed either in sealed glass containers or in glass containers which allowed limited aeration of the tobacco undergoing treatment. Ratios of tobacco, inoculum and water were the same as Example 6. All tobacco, inoculum, water and other materials were carefully weighed when being placed into or being removed from a treatment system. Moisture analyses were performed as required. Two systems of each type were prepared; one of each type was incubated for 16 hours and the other for 40 hours. The alkaloid data and mass change data are presented below.

| System Description | Alkaloids (% Dry Wt) | Mass Change |
|---|---|---|
| Untreated tobacco | 3.55 | — |
| Sealed System 16 hours | 2.02 | 0.00% |
| Sealed system 40 hours | 1.10 | +2.10% |
| Ventilated System 16 hrs. | 2.31 | −0.71% |
| Ventilated System 40 hrs. | 0.45 | −3.6 % |

EXAMPLE 17

Four pounds of burley lamina was treated by adding two lbs. of *P. putida* (NRRL B-8061) inoculum. The culture had been grown in tobacco-nicotine broth for 48 hours in shake flasks as described in Example 1. Water was added to the system to bring the moisture level to 75%. The tobacco was then placed in a tray, loosely covered with a sheet of plastic, and incubated at 32° C. for 24 hours. The alkaloid content of the tobacco was reduced from 3.78% to 2.29%. A mass loss of tobacco of 5.3% was calculated from weight and moisture determinations.

EXAMPLE 18

Ten grams of burley tobacco, which had been treated with *P. putida* (NRRL B-8061) as described in Example 6, was extracted with 100 mls of $NH_4OH$, pH 9.5. The extraction period was 30 minutes at room temperature with stirring. The extract was adjusted to pH 3.5 with 1 N HCl, then extracted three times with 100 mls of chloroform. The chloroform fractions were combined and the solvent removed. 3-succinoylpyridine was identified in the residue by mass spectral analysis. Burley lamina which had not been treated with *P. putida* (NRRL B-8061) gave no evidence of 3-succinoylpyridine when examined in the same fashion.

EXAMPLE 19

*P. putida* (NRRL B-8061) was grown in burley nicotine infusion broth (250 ml/500 ml flask) as described in Example 1, for 22 hours at 30° C. with rotary agitation. This culture was used to inoculate an 8 liter sterilized burley blend extract broth at 5% (v/v) rate contained in a 14 liter fermentor jar attached to a New Brunswick Scientific Microferm Fermentor (Model No. MF-214). Data shown below indicate the positive rise in population and alkaloid degradation pattern during growth and specific growth conditions.

Burley tobacco was treted with inoculum from this 8 liter culture at 0, 3.5, 5.75, 6 and 6.5 hours culture age. The treatment was accomplished by applying 30 mls of the culture to 10 gms of cut burley tobacco, mixing thoroughly, and immediately spreading the tobacco in a glass dish to dry at room conditions.

| Sampling Time | Culture Growth/ Alkaloid Degradation: Cell Concentration ($\times 10^6$) | Alkaloid Content (mg/ml) | pH | Tobacco Treatment: Total Alkaloids Remaining in Burley Blend After Treatment (%) |
|---|---|---|---|---|
| Before inoculation | — | 1.84 | 7.01 | |
| Inoculum | 1,160 | 0.10 | 7.7 | |
| 0 hrs. after inoc. | 43 | 1.77 | 7.08 | 3.01 |
| 1 hr. after inoc. | 52 | 1.68 | 7.01 | |
| 2 hrs. after inoc. | 111 | 1.65 | 7.00 | |
| 3 hrs. after inoc. | 500 | 1.56 | 7.14 | |
| 3.5 hrs. after inoc. | — | — | — | 2.92 |
| 4 hrs. after inoc. | 1,040 | 1.26 | 7.55 | |
| 5 hrs. after inoc. | 1,900 | 0.97 | 7.53 | |
| 5.75 hrs. after inoc. | — | — | — | 1.39 |
| 6 hrs. after inoc. | 3.100 | 0.19 | 7.66 | 0.87 |
| 6.5 hrs. after inoc. | — | — | — | 0.90 |
| 7 hrs. after inoc. | 5,600 | 0.19 | 7.85 | |

GROWTH CONDITIONS:
Medium: 8 liters burley extract broth (sterilized) in 14 liter fermentor jar
Agitation: 600 rpm - drive shaft having 2 turbine impellers
Aeration: 8,000 cc air/min. - (Single orifice sparger)
Temperature: 30° C
Inoculum rate: 5% (v/v)
Antifoam: P-1200 (Dow)
pH Control: (New Brunswick Scientific pH controller Model No. PH 22) using two normal sodium hydroxide and two normal hydrochloric acid.

EXAMPLE 20

*P. putida* (NRRL B-8062) inoculum was prepared and used to treat a burley blend as described in Example 19. Data for this treatment are shown below:

| Sampling Time | Cell Concentration ($\times 10^6$) | Alkaloid Content mg/ml | pH | Tobacco Treatment: Total Alkaloids Remaining in Burley Blend After Treatment (%) |
|---|---|---|---|---|
| Before Inoc. | — | 1.92 | 6.33 | |
| Inoculum | 810 | 0.1 | 7.32 | |
| 0 hrs. after | 44 | 1.71 | 7.60 | |
| 1 hr. after | 36 | 1.66 | — | |
| 2 hrs. after | 58 | 1.56 | 7.37 | |
| 3 hrs. after | 118 | 1.57 | 7.46 | |
| 4 hrs. after | 400 | 1.50 | 8.78 | |
| 5 hrs. after | 1,250 | 1.39 | 8.18 | |
| 6 hrs. after | 1,200 | 1.28 | 7.80 | |
| 6.75 hrs. after | — | — | — | 1.92 |
| 7 hrs. after | 2,300 | 0.43 | 7.68 | |
| 7.5 hrs. after | 2,300 | 0.13 | 7.93 | |

-continued

| Sampling Time | Cell Concentration ($\times 10^6$) | Alkaloid Content mg/ml | pH | Tobacco Treatment: Total Alkaloids Remaining in Burley Blend After Treatment (%) |
|---|---|---|---|---|
| 7.75 hrs. after | — | — | — | 2.88 |

GROWTH CONDITIONS:
Medium- 8 liters burley extract broth (sterilized) in 14 liter fermentor jar
Agitation: 600 rpm - drive shaft having 2 turbine impellers
Aeration: 8,000 cc air/min. - (Single orifice sparger)
Temperature: 30° C
Inoculum rate: 5% (v/v)
Antifoam: P-1200 (Dow)
pH Control: Same as Example 19

EXAMPLE 21

*Cellulomonas sp.* (NRRL B-8063) inoculum was prepared and used to treat a burley blend as described in Example 19. Data for this treatment are shown below:

| Sampling Time | Cell Concentration ($\times 10^6$) | Alkaloid Content (mg/ml) | pH | Total Alkaloids Remaining in Burley Blend After Treatment (%) |
|---|---|---|---|---|
| Before Inoc. | — | 1.80 | 6.60 | |
| Inoculum | 2,200 | 0.11 | 7.52 | |
| 0 hrs. after | 39 | 1.74 | 7.13 | |
| 1 hr. after | 99 | 1.68 | 7.16 | |
| 2 hrs. after | 240 | 1.47 | 7.09 | |
| 3 hrs. after | 520 | 1.45 | 7.18 | |
| 4 hrs. after | 1,280 | 1.36 | 7.70 | |
| 5 hrs. after | 2,400 | 0.972 | 7.60 | 2.61 |
| 6 hrs. after | 2,900 | 0.540 | 7.10 | 2.60 |
| 7 hrs. after | — | — | — | 1.87 |

GROWTH CONDITIONS:
Medium: 8 liters burley extract broth (sterilized) in 14 liter fermentor jar
Agiation: 600 rpm - drive shaft having 2 turbine impellers
Aeration: 8,000 cc air/min. - (Single orifice sparger)
Temperature: 30° C
Inoculum Rate: 5% (v/v)
Antifoam: P-1200 (Dow)
Ph Control: Same as Sample 19

Those skilled in the art will visualize that many modifications and variations may be made in the invention set forth without departing from its spirit and scope. Accordingly, it is understood that the invention is not confined to the specifics set forth by way of illustration.

What is claimed is:

1. Tobacco treated by a process comprising:

a. contacting said tobacco with an aqueous medium containing at least $1 \times 10^7$ cells per gram based on the dry weight of said tobacco of a microorganism which degrades nicotine through a biochemical mechanism in which 3-succinoylpyridine is formed; and b. maintaining said tobacco in contact with said microorganism for from about 1 to about 50 hours at a moisture level of at least 50% by weight based on the total weight of tobacco and water, a temperature of from about 20° C. to about 45° C., and an initial pH of from about 5 to about 8.

2. The product of claim 1 wherein the initial pH is maintained from about 6 to about 7.5.

3. The product of claim 1 wherein the temperature is maintained from about 27° C. to about 32° C.

4. The product of claim 1 wherein the microorganism is maintained in contact with said tobacco for from about 1 to about 10 hours.

5. The product of claim 1 wherein the said moisture level is maintained at least at 65% by weight.

6. The product of claim 1 wherein said microorganism is selected from the group consisting of Cellulomonas sp. and Pseudomonas putida.

7. The product of claim 1 in which an aqueous slurry containing up to 20% by weight tobacco is inoculated with said microorganism.

* * * * *